US005365638A

United States Patent [19]

Braid et al.

[11] Patent Number: 5,365,638

[45] Date of Patent: Nov. 22, 1994

[54] SPRING MOUNTING FOR SASH FRAME TENSIONING ARRANGEMENTS

[76] Inventors: Harold K. Braid, The Sheilings, Braceborough, Lincolnshire, PE9 4NT; Simon C. Braid, 13, Crowson Way, Deeping, St. James, Lincolnshire, both of England

[21] Appl. No.: 7,628

[22] Filed: Jan. 21, 1993

[30] Foreign Application Priority Data

Jan. 21, 1992 [GB] United Kingdom ..... 9201208.7
Feb. 25, 1992 [GB] United Kingdom ..... 9204006.2
Mar. 4, 1992 [GB] United Kingdom ..... 9204687.9

[51] Int. Cl.[5] ..... E05D 13/00
[52] U.S. Cl. ..... 16/197
[58] Field of Search ..... 16/197, DIG. 16

[56] References Cited

U.S. PATENT DOCUMENTS 2,732,594 1/1956 Adams et al. ..... 16/197
2,873,472 2/1959 Foster ..... 16/197
3,452,480 7/1969 Foster ..... 16/197
3,992,751 11/1976 Foster et al. ..... 16/197
4,227,345 10/1980 Durham .
5,157,808 10/1992 Sterner ..... 16/197

FOREIGN PATENT DOCUMENTS 825513 12/1959 United Kingdom .
1505782 3/1978 United Kingdom .
2253874 9/1992 United Kingdom .

*Primary Examiner*—P. Austin Bradley
*Assistant Examiner*—Chuck Y. Mah
*Attorney, Agent, or Firm*—Steven H. Bazerman

[57] ABSTRACT

A mounting element and assembly for a sash frame tensioner used in a sash window frame to support the window in any desired open position, the assembly comprising a channel section member and a sash frame support element slidable in said channel section member. A coiled ribbon spring having a free outer end thereof engaged with said sash frame support member, and a mounting element, the mounting being disposed between the sash frame support member and a coiled body portion of said coiled ribbon spring with a free end of said coiled ribbon spring disposed alongside said mounting, said mounting being secured to said channel section member, directly or indirectly, and in use impinging upon an outer surface of said coiled body portion to retain said coiled body portion in position during uncoiling of said coiled ribbon spring as said sash support member is moved away from said coiled body portion.

8 Claims, 4 Drawing Sheets

FIG. 6.
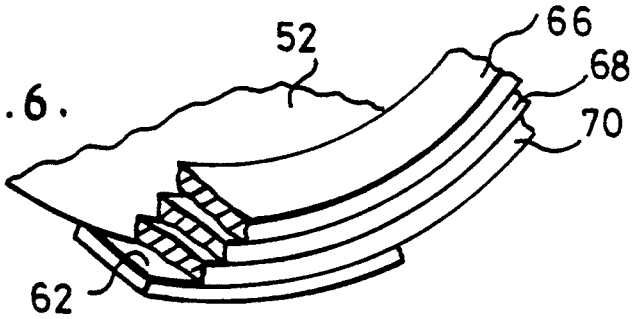
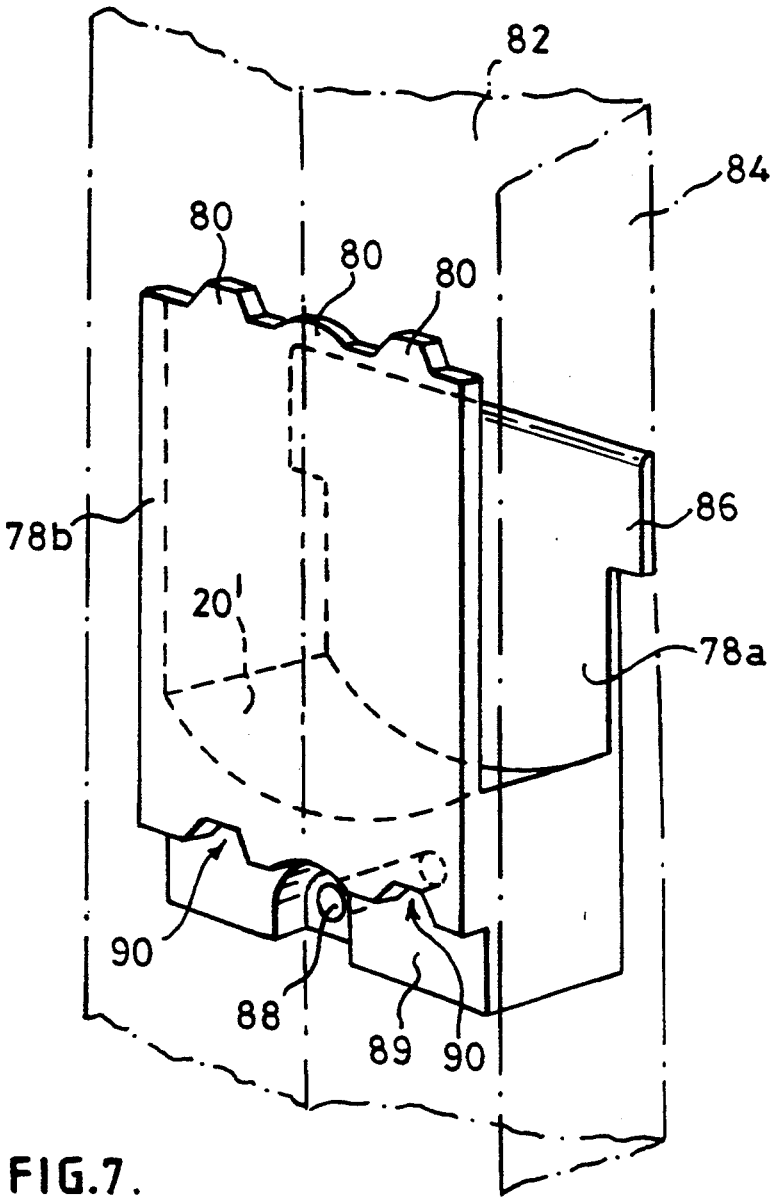
FIG. 7.

SPRING MOUNTING FOR SASH FRAME TENSIONING ARRANGEMENTS

BACKGROUND OF THE INVENTION

The invention relates to a mounting for a coiled ribbon spring and is particularly, though not exclusively, applicable to sash springs used in sash frame tensioning arrangements for windows.

Such coiled ribbon springs are in the form of a flat coil with an open area at their center and two free ends, an outer one on the outside of the coil and one on the inside; the springs being similar in construction to clock springs except that the inner free end is not (as in a clock spring) secured to a fixed point.

It is known in the art to mount such coiled ribbon springs on a drum within a hollow channel in a window frame by means of a screw or other fixing, about which the spring is able to uncoil as an outer free end of the spring attached to a window sash moves away from the coil as the sash is moved. The drum may be arranged to be stationary or to rotate with the spring, through the drum is provided only to guide the spring and is not operatively secured thereto (thus, if the spring were unwound too far, it would be unwound completely from the drum).

It is a feature of these known mountings that the spring is supported from the open space within the coil so that an upper part of the coil rests on the drum with a lower part of the coil slung below the drum and not supported thereby. It is, as stated above, a feature of such springs that the inner free end of the spring is not secured to any point (on the drum or elsewhere) such springs being referred to in some instances as "constant tension" springs.

The drum is merely to provide a reaction member and as a means of retaining the body of the spring loosely in position in the channel as its free outer end is uncoiled.

It has been a disadvantage of this known type of mounting that the spring is not silent in use, possibly due to relative movement between the inner, free end of the spring and the spring support drum.

The present invention seeks to overcome this disadvantage.

SUMMARY OF THE INVENTION

The invention provides a mounting assembly comprising a channel section member, a sash frame support element slidable in said channel section member, a coiled ribbon spring having a free outer end thereof engaged with said sash frame support member, and a mounting element, the mounting being disposed between the sash frame support member and a coiled body portion of said coiled ribbon spring with a free end of said coiled ribbon spring disposed alongside said mounting, said mounting being secured to said channel section member, directly or indirectly, and in use impinging upon an outer surface of said coiled body portion to retain said coiled body portion in position during uncoiling of said coiled ribbon spring as said sash support member is moved away from said coiled body portion.

The present invention also provides a mounting element for use in the assembly set forth above, the mounting comprising a body portion having means for securing the mounting in a channel portion of a sash frame or other abutment and having a support surface disposed so as to impinge upon an outer surface of the spring coil.

In normal circumstances the channel section member will in use be mounted substantially vertically and thus said mounting element will support an outer undersurface of said coiled body portion from below. Thus, normally the sash frame support member will be disposed in use beneath the mounting element which is itself disposed beneath the coiled body portion.

It will be understood that the mounting element is to be operatively disposed between the spring body portion and the sash frame support member.

Preferably, the mounting element comprises a body portion having an aperture therein to receive, in use, a fixing screw by which the mounting element may be secured to said frame or abutment, an upper surface of the body portion being concavely curved to support the curved outer undersurface of the spring, thus providing said support surface.

In this inventive arrangement the spring merely rests on the mounting element which acts as a reaction member which the spring abuts as a free outer end, attached to the sash, is unwound. (Ideally, there is a slight tension in the spring when at rest so there is no likelihood of the spring being displaced should the sash from be inverted for any reason).

The mounting element may be provided with inter-engagement formations by which a plurality of such elements may be stackingly inter-engaged, thus enabling a plurality of coiled ribbon springs to be used at a single location, only one fixing element or screw being required to secure the said stack against movement as the sash frame support member moves. The inter-engagement formations may be in the form of tooth-like projections cooperable with corresponding complementary detentes in another such mounting element. The inter-engagement formations may in addition or as an alternative be formed so as to provide an interference fit with formations of another mounting element or a "snap fit" therewith.

Alternatively, the mounting element may be configured such that there is a hub portion having an aperture therein to receive, in use, a fixing screw by which the mounting element may be secured to the frame or abutment; the hub portion being disposed such that in use the spring encircles such hub portion, the mounting element having an arm portion slung below said hub portion and disposed so as to support said outer undersurface of said spring.

In this arrangement, the hub portion loosely impales the spring body portion but in normal circumstances the hub portion does not support the spring, all the support is rendered by the arm portion slung below the hub portion. (In fact, in certain instances, i.e., when the spring is fully extended, the hub portion may also provide some minor support, though this is not its function).

The mounting element may be provided with formations conformed so as to cooperate with a portion of the sash frame within which the element is to be received, such that contact of said formations with said sash frame inhibits in a rotational, pivoting, or twisting sense of the element relative to the sash frame.

It will be apparent that the mounting element does not rotate or otherwise move with the spring but is substantially stationary when the spring is in operation.

BRIEF DESCRIPTION OF THE DRAWINGS

Embodiments of the invention will now be described by way of example only and with reference to the accompanying drawings in which:

FIG. 6 is a schematic view on an enlarged scale of a portion of the mounting assembly shown in FIGS. 3, 4 and 5;

FIG. 7 is a schematic perspective view on an enlarged scale of a third mounting element according to the invention;

DESCRIPTION OF THE PREFERRED EMBODIMENTS

Figure 1:
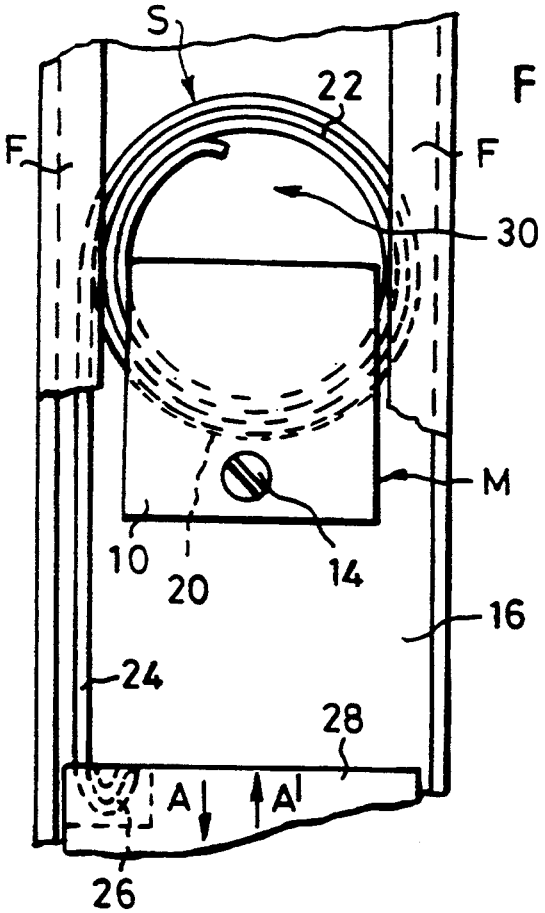
FIG. 1 is a schematic side elevational view shown partly broken away of an assembly according to the invention showing a coiled ribbon spring supported by a mounting element according to the invention in a vertical channel section of a sash window.

The mounting assembly shown in FIG. 1 comprises a mounting element shown generally as M having a body portion 10 having a bore 12 therein to receive a fixing screw 14 by means of which the mounting element may be secured to a channel section 16 of a sash frame. The mounting element is dimensioned so as to be capable of insertion into the channel section from the side (i.e., without the necessity to slide the mounting element in from the end of the channel section).

The mounting is shown so fixed in FIG. 1. The body portion 10 has two upstanding walls 18 and disposed therebetween is a support surface 20 which is concavely curved to receive a coiled body portion 22 of a coiled ribbon spring shown generally as S, such that the coiled body portion 22 rests on said surface 20 between said walls. An outer free end 24 of the coiled ribbon spring S is provided with a hooked end 26 engageable with a sash frame support element 28 which forms part of a sliding sash. The sash frame support element 28 is slidable in the channel section 16 back and forth in the directions of arrows A, A', to move the sash.

It is to be noted that only a few coils of the coiled ribbon spring have been shown in the figures for simplicity. In practice, many more coils wold be provided. Also, the thickness of the coiled ribbon spring has been exaggerated.

As the sash frame support element 28 (and so the sash) is moved downwardly in the direction of arrow A the coiled ribbon spring unwinds.

It may be the case during this unwinding that the curvature of the undersurface of the coiled body portion 22 does not conform exactly to the curvature of the surface 20. This is of no particular importance as the mounting only has a guiding and support function. It will e noted that the coiled ribbon spring is not supported from within the coil (shown generally as 30) as it is in the prior art. In the embodiment shown in FIGS. 3 to 6, the mounting element is in two parts 50, 52 which inter-engage to form a body portion 54 of reel-like structure but having a tube-like hub 56 which, in use, loosely impales a body portion of the coiled ribbon spring 58 but provides no support therefor.

A support portion 60 is provided slung below (when used in vertical sash frames as is usual) the tube 56 on part 52 and is provided with a curved support surface 62 the counterpart of the support surface 20 in the first embodiment. There is then provided on part 50 a bracing portion 64 inter-engageable with the under surface of the support portion 60 (see FIG. 5). As will be seen from FIG. 3 an outer undersurface of the coiled body portion of the coiled ribbon spring rests on the support surface 62, and is supported thereby. The hub 56 receives in use a fixing screw 64 by which the mounting may be fixed to a channel section member. FIG. 6 shows portions of coils 66, 68 and 70 of the spring, coil 70 being the outermost and having its outer undersurface supported by the support surface 62.

Figure 2:
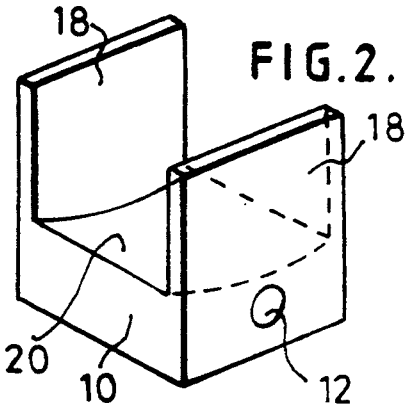
FIG. 2 is a perspective view of the mounting element shown in FIG. 1.
Figure 3:
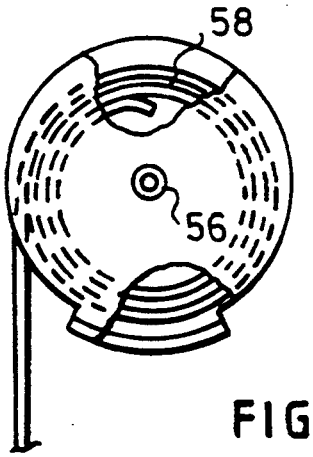
FIG. 3 is a schematic side elevational view shown partly broken away of a mounting assembly for a coiled ribbon spring, showing a second mounting element according to the invention.
Figure 4:
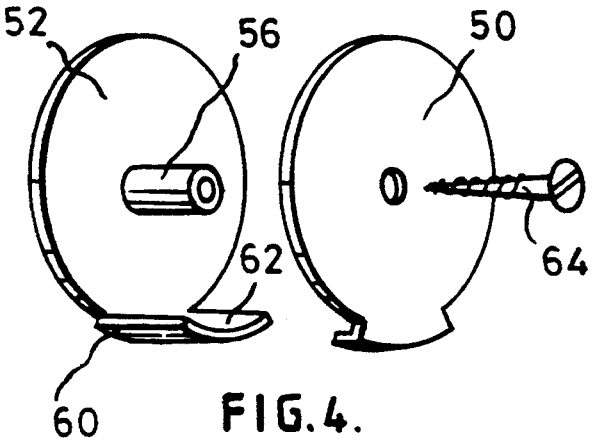
FIG. 4 is an exploded schematic view of the mounting assembly shown in FIG. 3.
Figure 5:
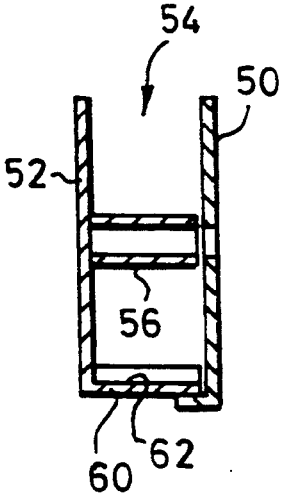
FIG. 5 is a sectional view on line V—V of FIG. 3 with the coiled ribbon spring removed.

The mounting element shown in FIG. 7 is similar to that shown in FIGS. 1 and 2 except firstly that upstanding walls $78^a$ and $78^b$ are dissimilar and secondly that inter-engagement formations 80 are provided to enable a plurality of said elements to inter-engage in a stacked manner.

One of the upstanding walls $78^a$ which is intended to lie against a back surface 82 (shown in broken line) of a channel section frame (shown as 84 in part hatched line) is provided with a pair of lateral ears 86 (only one of which is shown full line) which are intended to prevent rotation of the mounting element about a fixing screw (not shown) received, in use, in recessed bore 88. A concavely curved surface 20' is provided in similar manner to the embodiment of FIGS. 1 and 2. A second upstanding wall $78^b$ has greater thickness than upstanding wall $78^a$ and is provided with a plurality of tooth-like inter-engagement formations 80. There is provided a rebate 89 of a depth equal to the thickness of the upstanding wall $78^b$ and provided with a plurality of detentes 90 corresponding to formations 80 such that the formations of one element as shown in FIG. 7 can engage in detentes 90 of another identical element lying above the first element. Thus, two or more coiled ribbon springs can be mounted one above the other with their mounting elements inter-engaged and only a lower one of said mounting elements need be secured with a screw as hereinbefore described.

Figure 8:
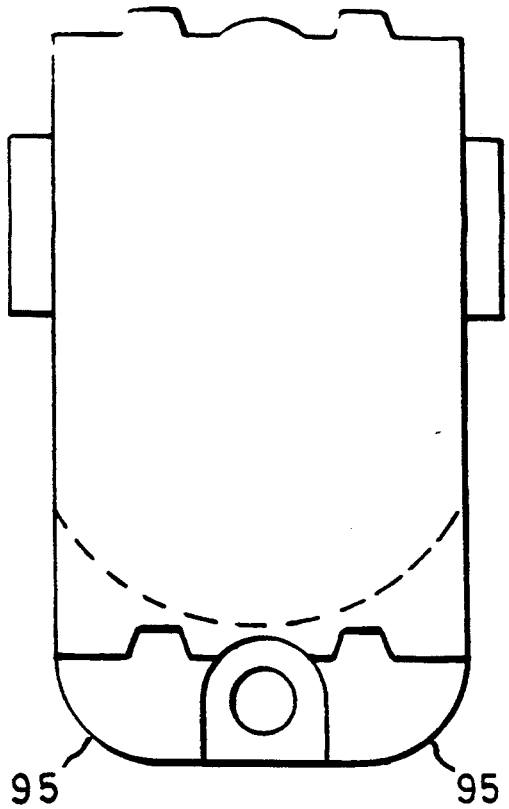
FIG. 8 is a schematic front view of a fourth mounting element similar to said third mounting element, according to the invention.

FIG. 8 shows a fourth mounting element in accordance with the invention. This is closely similar to that shown in FIG. 7 except that at lower corner regions shown generally as 95, the element is rounded off for ease of insertion of the element into the sash frame.

Figure 9:
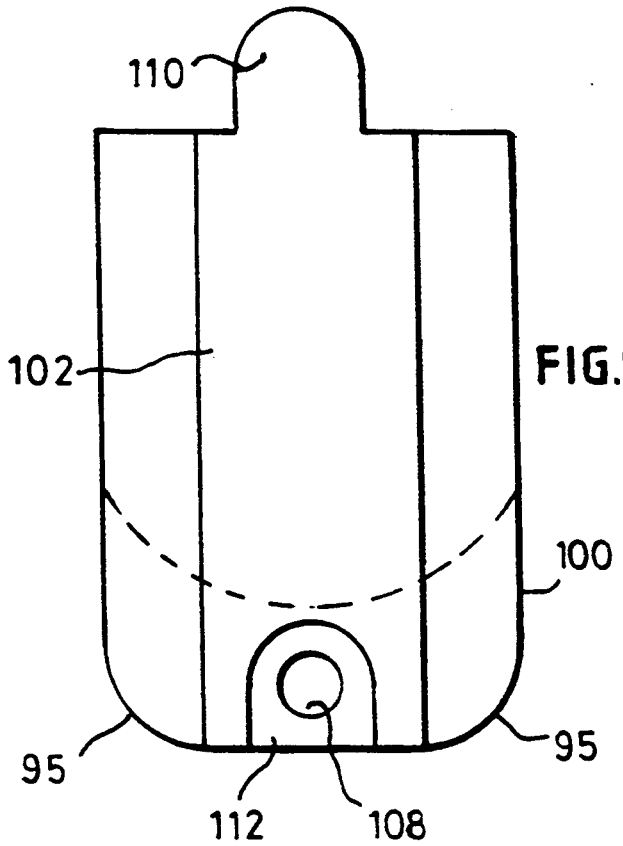
FIG. 9 is a partial schematic front view of a fifth mounting element similar to said third and fourth mounting elements according to the invention.
Figure 10:
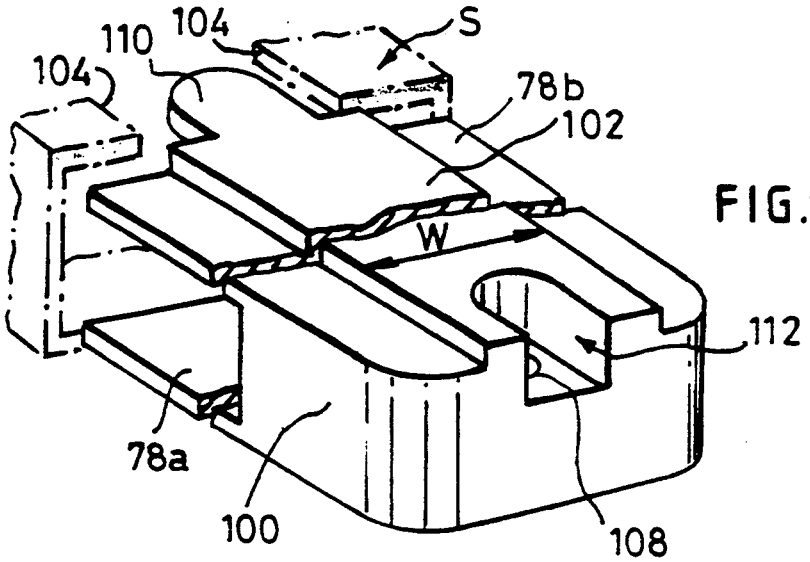
FIG. 10 is a schematic perspective view of the element of FIG. 9 shown on a larger scale and partially broken away so as to foreshorten the element.

The mounting element 100 shown in FIGS. 9 and 10 is similar to those of FIGS. 7 and 8 and some of those portions of the element similar to those provided in the elements shown in FIGS. 7 and 8 have been labelled with the same reference numerals. The mounting element 100 is devoid of the lateral ears 86 but instead is provided with a raised spine formation 102 whose width W is arranged such that it is a snug fit between open lip portions 104 of a channel section sash frame member 5 (shown in broken line in FIG. 10) within which the mounting element is to be operatively received. Thus, rotational, pivoting or twisting motion of the element 100 within the sash frame member 5 is inhibited. The element 100 is secured in the sash frame member 5 by a screw or other suitable fixing via a bore 108 in a similar manner to that of the element shown in FIG. 7. In the mounting element 100 a single inter-engagement projection formation 110 is provided, which is cooperable with a corresponding recess formation 112 of a second such element, so that elements can be "stacked" as in previous embodiments.

Figure 11:
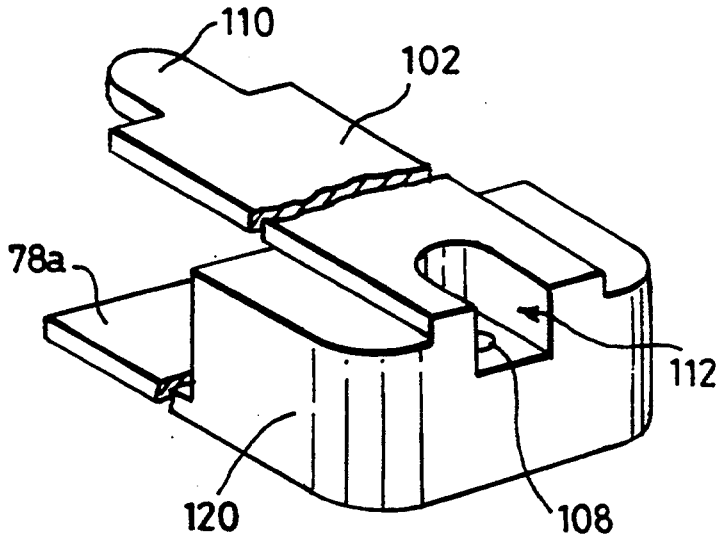
FIG. 11 is a schematic perspective view of a fifth mounting element according to the invention being similar to that shown in FIG. 10 with certain differences.

The mounting element 110 shown in FIG. 11 is similar to that shown in FIG. 10 except that the upstanding wall 78$^b$ is provided entirely by said raised spine formation 102. This is especially useful where space is limited, *i.e.*, the depth of the coiled ribbon spring approaches the depth of the channel section sash frame member.

Figure 12:
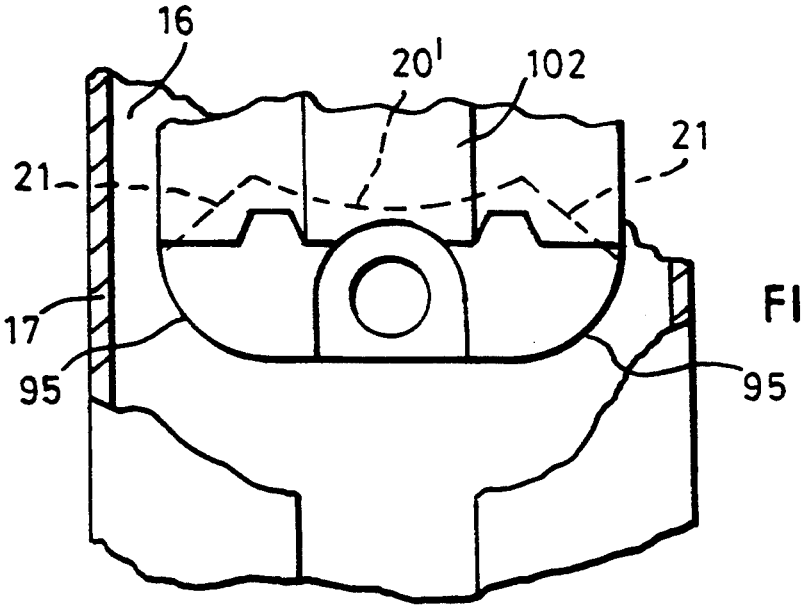
FIG. 12 is a partial front elevational view of a further mounting element similar to those shown in FIGS. 7 and 8 with certain differences.

The mounting element shown in FIG. 12 is similar to those shown in FIGS. 7 and 8 and the same reference numerals have been used to indicate corresponding portions thereof. It has the rounded off regions 95 of the mounting element shown in FIG. 8 but differs in that it has a locating rib 102 like that shown in FIGS. 9 and 10 and the curved surface 20' (shown in broken line) is truncated at outer regions thereof by sloping shoulders 21 (shown in broken line). These enable a free end of a spring, supported by the mounting element in use, to be more easily fed between the mounting element and a wall 17 of a channel section 16, providing a funnel-like provision.

It will readily be apparent that the inter-engagement formations need not be as shown in the Figures but may be of any suitable shape, and number.

They may also be made to be interlocking, releasable or otherwise. It is to be understood that in the channel section partly shown in broken line in FIG. 7 the front retaining flanges shown in FIG. 1 at F have not been shown.

It will be noted that in none of the embodiments does the mounting element move with the spring.

It will be apparent that other methods of securing the mountings to a frame or abutment may be used. For example, two or more screw or other fixings would prevent any tendency for the mountings to move or rotate in use. Alternatively, pegs, spigots or catches could be used.

The previous descriptions of the preferred embodiments of the present invention are for purposes of illustration and are limited only by the provisions of the following claims.

What is claimed is:

1. A mounting assembly comprising a channel means having a rear wall, side walls and at extremities of said side walls, inwardly turned opposed flanges, a sash frame support means slidable in said channel means, a coiled ribbon spring having a first end engaged with said sash frame support means, and a means for mounting said coiled ribbon spring, the coiled body portion of said coiled ribbon spring having the other end of said coiled ribbon spring within the coil being positioned in said mounting means, said other end of said coiled ribbon spring being free and unattached to said mounting means and said mounting means being secured in said channel means, said mounting means having a raised spine positioned between and in the same plane as said inwardly turned opposed flanges of said channel means whereby rotational motion of said mounting means is inhibited.

2. The mounting assembly of claim 1 wherein the mounting means has a support surface disposed in contact with the outer surface of said coiled body portion of said coiled ribbon spring during movement of said coiled ribbon spring as said sash support means moves in said channel means.

3. The mounting assembly of claim 2 wherein said mounting means has a body portion having an aperture therein, a fixing screw positioned in said aperture by which the mounting means is secured relative to said channel means, a surface of said body portion being concavely curved, said coiled body portion of said coiled ribbon spring being in contact with and supported by said curved surface of said body portion.

4. The mounting assembly of claim 2 in which the mounting means has at least one inter-engagement means by which a plurality of such mounting means may be stacked in inter-engagement.

5. The mounting assembly of claim 4 in which the inter-engagement means comprises a tooth-like projection cooperable on said first mounting means with a corresponding complementary detente in a second mounting means.

6. The mounting assembly of claim 4 in which the inter-engagement means on said first mounting means is in an interference fit with an inter-engagement means on said second mounting means.

7. The mounting assembly of claim 4 in which the inter-engagement means is formed so as to provide a snap fit.

8. A mounting assembly comprising a channel means having a rear wall, side walls and at extremities of said side walls, inwardly turned opposed flanges, a sash frame support means slidable in said channel means, a coiled ribbon spring having an outer end engaged with said sash frame support means, and a means for mounting said coiled ribbon spring, the coiled body portion of said coiled ribbon spring with the other end of said coiled ribbon spring positioned in said mounting means, said mounting means being secured in said channel means and the mounting means having projection means positioned between said inwardly turned opposite flanges of the channel means which cooperate with said flanges of the channel means within which the mounting means is positioned, whereby rotational movement of the mounting means is inhibited.

* * * * *